United States Patent [19]

Gorin

[11] 4,138,222

[45] Feb. 6, 1979

[54] PELLETIZATION OF COAL CONVERSION PRODUCTS

[75] Inventor: Everett Gorin, San Rafael, Calif.

[73] Assignee: Continental Oil Company, Stamford, Conn.

[21] Appl. No.: 861,081

[22] Filed: Dec. 15, 1977

[51] Int. Cl.[2] ..... C10L 5/00; C10L 5/16; C10G 1/00

[52] U.S. Cl. ..... 44/10 C; 44/23; 44/24; 201/5; 208/8

[58] Field of Search ..... 44/1 B, 23, 24, 10 C, 44/10 R, 1 F; 201/5; 208/8

[56] References Cited

U.S. PATENT DOCUMENTS

| | | | |
|---|---|---|---|
| 3,791,956 | 2/1974 | Gorin et al. | 208/8 |
| 3,920,418 | 11/1975 | Rice | 208/8 X |
| 4,008,054 | 2/1977 | Clancey et al. | 44/10 R |
| 4,075,080 | 2/1978 | Gorin | 208/8 |

*Primary Examiner*—Carl Dees

*Attorney, Agent, or Firm*—D. Leigh Fowler; F. Lindsey Scott; William A. Mikesell

[57] ABSTRACT

Pelletization of a pumpable non-distillable conversion product of coal is effected by agglomerating, in a pelletization zone, a mixture of such product with finely divided coaly solids and recycled undersized pellets from solvent extract and pellet classification zones.

3 Claims, 1 Drawing Figure

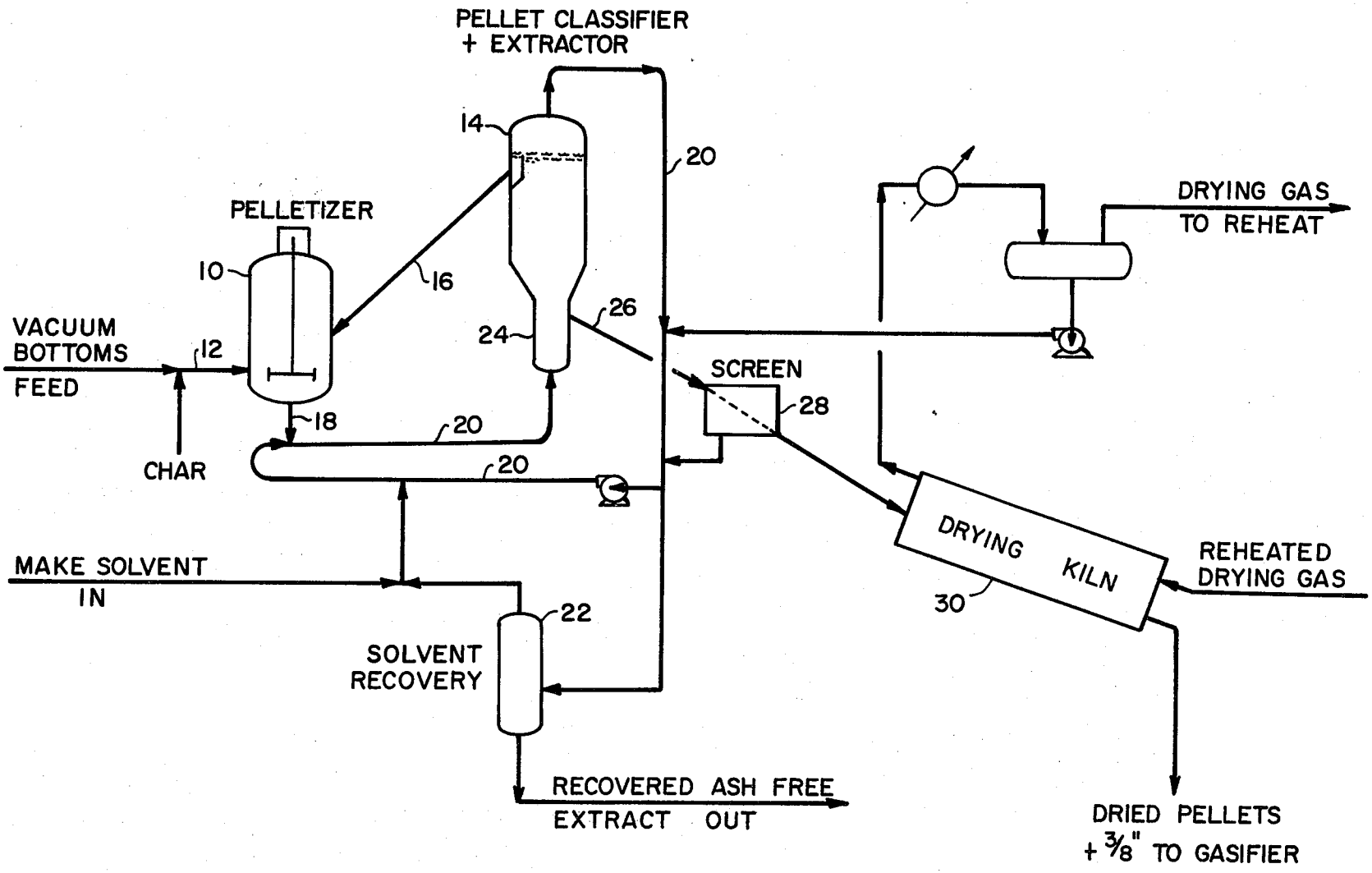
DRYING GAS TO REHEAT
REHEATED DRYING GAS
DRIED PELLETS +3/8" TO GASIFIER
DRYING KILN
30
SCREEN
28
20
PELLET CLASSIFIER + EXTRACTOR
26
14
24
16
20
20
22
RECOVERED ASH FREE EXTRACT OUT
SOLVENT RECOVERY
PELLETIZER
18
10
12
CHAR
VACUUM BOTTOMS FEED
MAKE SOLVENT IN

PELLETIZATION OF COAL CONVERSION PRODUCTS

This invention relates to an improvement in coal conversion processes, and, more particularly, to the pelletization of a pumpable non-distillable portion of the products obtained in such processes.

Coal conversion processes include coal carbonization at low, medium and high temperatures; coal gasification; coal liquefaction, and so on; to produce widely varying amounts and kinds of liquids, gases, and solids, depending on the conditions and reactants employed. Generally, in all such processes, a liquid pyrolysis product is obtained, to a greater or less degree, which is non-distillable (without coking) and which also, but not necessarily, contains ash and carbonaceous solids. Such liquids, by themselves, are difficult to handle, are hydrogendeficient, and if ash is present, are of low Btu value.

The primary purpose of the present invention is to provide an improved process for the pelletization of a pumpable non-distillable product normally produced in coal conversion processes, and particularly, those products which contain coaly solids.

SUMMARY OF THE INVENTION

In accordance with my invention, a pumpable nondistillable product obtained in a coal conversion process is subjected to a combined solvent extraction-pelletizing operation. A process is proposed wherein the non-distillable liquid product, in admixture with extraneously added finely divided coaly solids is mixed with a circulating stream of particulate coal-derived carbonaceous solids in a pelletization zone under pelletizing conditions to form pellets. These pellets are passed to a solvent extraction zone and a pellet classification zone which may be the same zone. Excess liquid which coats the pellets is removed by solvent extraction. The purpose is to permit the pellets to harden and to recover ash-free liquid product. The larger pellets of desired size are separated from those which are too small. The latter are recycled in the circulating stream to the pelletization zone. A suitable temperature range in the pelletization zone is about 200–300° C. A suitable solvent for the solvent extraction zone is one which selectively dissolves the liquid coating on the pellets. The pellets of desired size are recovered and freed of any occluded solvent by any suitable means.

For a better understanding of my invention, its objects and advantages, reference should be had to the following description of the preferred embodiment of the present invention and to the accompanying drawing which illustrates schematically the preferred embodiment.

PREFERRED EMBODIMENT

In the preferred embodiment of the present invention, the feedstock to my improved process is obtained from those coal liquefaction processes (now well-known) wherein a liquefaction solvent is present during the liquefaction of the coal. Liquefaction may be achieved by hydrogenation, depolymerization, extraction, etc. The liquefaction solvent, which is generally coal-derived, may function as solvent for the coal or for the products, or both. It may also play a reactive role, for instance, in the depolymerization and hydrogenation of the coal molecules. Liquefaction may also be achieved with or without the presence of a catalyst, and with or without the presence of molecular (gaseous) hydrogen, in addition to the liquefaction solvent. Such liquefaction processes may be used to make liquid and gaseous fuels, as well as low sulfur and non-caking feedstocks for fixed bed gasifiers.

The effluent slurry product of a coal liquefaction process such as has just been described contains extract which comprises both distillable and non-distillable fractions; a distillable but generally high boiling liquefaction solvent; and undissolved ash-containing carbonaceous solids, a substantial portion of which is suspended in the solution because of their micron and submicron size. The feed to the preferred embodiment of my process is one which has been obtained as a pumpable bottoms fraction of the vacuum distillation of the entire effluent slurry product. The solids are essentially all concentrated in the bottoms fraction. If desired, further concentration may be achieved by selective solvent extraction with a distillable fractionating solvent which preferentially dissolves the lower molecular weight part of the non-distillable residuum.

Referring now to the drawing, the feedstock consisting essentially of the vacuum bottoms described above, in admixture with finely divided char (the solid residue of low temperature carbonization of coaly materials) is continuously fed to a Pelletizer 10 through a conduit 12. The Pelletizer is illustrated as a vertical mechanically agitated vessel. It may, however, be a rotating kiln or other suitable pelletizing device.

Concurrently with the introduction of the vacuum bottoms and char, a slurry of undersize pellets in a heavy naphtha solvent (b.p. 150–200° C.)is recycled to the Pelletizer from a Pellet Classifier and Extractor vessel 14 through a conduit 16. The vacuum bottoms is relatively insoluble in this solvent. The pelletizing operation is conducted so that the vacuum bottoms, char and undersize pellets agglomerate to form enlarged pellets.

The conditions in the Pelletizer 10 are maintained so that the vacuum bottoms is highly viscous. As a consequence, it serves as an effective binder for the solids. Sufficient agitation is supplied to ensure adequate mixing of binder and solids. The broad operating conditions are in the range of 200–350° C.with operation in the range 225–325° C.preferred. The operating pressure is dictated by the solvent chosen, but is normally less than 150 psig.

The enlarged pellets are circulated rapidly through a bottom draw-off conduit 18 into a solvent recirculatory conduit 20, and conducted to the Pellet Classifier and Extractor 14. Fresh solvent is supplied to the solvent recirculatory circuit by sending a portion of the recirculating through a Solvent Recovery Fractionator 22 where fresh solvent and ash-free liquid are separately recovered. The fresh solvent and any required make-up solvent are introduced into the solvent recirculatory conduit 20 in order to maintain the recirculating solvent in an effective condition for extracting excess liquid from the pellets. Hardening of the pellets results from the removal of liquid coating.

Classification of the pellets in the Pellet Classifier 14 is effected in accordance with the well-known principle of liquid fluidization. The recirculating solution of solvent and dissolved liquid is used as the classifying medium. A liquid fluidized bed, in contrast to a gas fluidized bed, is an extremely effective solids classification device. The up-flow velocity in the boot 24 of the vessel 14 is chosen so that preferably only pellets larger than 1 cm. size are withdrawn through the withdrawal conduit 26 to a screen 28. A clear interface will exist at the top of the liquid fluidized bed in vessel 14 from which a solids-free liquid is withdrawn through conduit 20. Undersize particles are recirculated from the top of the fluidized bed to the Pelletizer 10.

The temperature in the Classifier and Extractor 14 is approximately the same as that in the Pelletizer 10. However, a lower temperature, e.g. 25° C, may sometimes aid to ensure pellet hardening.

The underflow pellets from the Classifier which traverse the screen 28 are pellets of the desired size. Excess solvent is removed by draining through the screen and recycling to the solvent recirculatory conduit 20. The drained pellets may be suitably dried in a rotary kiln 30, using a heated drying gas to remove solvent at about 225–275° C. The solvent is suitably condensed from the heating gas and recycled to the solvent recirculatory system while the drying gas is sent to reheat.

The dried pellets may now be fed to a gasifier.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

I claim:

1. The process of pelletizing a pumpable non-distillable product derived from a coal conversion process which comprises:

a. circulating a stream of particulate coal derived solids to a pelletization zone in intimate contact with a slurry of said pumpable product in which there has been suspended finely divided coaly solids, under conditions such that said particulate coal-derived solids form agglomerates or pellets of larger size;

b. subjecting said pellets to solvent treatment to remove liquid coating from the surface of the pellets;

c. separating those pellets from step (b) which are smaller than desired, and recycling them to said pelletization zone for reprocessing; and d. recovering the pellets of desired size from step (b).

2. The process according to claim 1 wherein said pumpable non-distillable product is the bottoms fraction obtained by vacuum distillation of the effluent slurry obtained by the solvent extraction of coal.

3. The process according to claim 2 wherein said coaly solids are char, the solids product obtained by the low temperature carbonization of coaly solids.

* * * * *